US010477943B2

(12) United States Patent
Kang

(10) Patent No.: US 10,477,943 B2
(45) Date of Patent: Nov. 19, 2019

(54) VOLUME CREAM CONTAINER

(71) Applicant: Seong Il Kang, Seongnam-si (KR)

(72) Inventor: Seong Il Kang, Seongnam-si (KR)

( * ) Notice: Subject to any disclaimer, the term of this patent is extended or adjusted under 35 U.S.C. 154(b) by 0 days.

(21) Appl. No.: 15/742,308

(22) PCT Filed: Jul. 1, 2016

(86) PCT No.: PCT/KR2016/007089
§ 371 (c)(1),
(2) Date: Jan. 5, 2018

(87) PCT Pub. No.: WO2017/007178
PCT Pub. Date: Jan. 12, 2017

(65) Prior Publication Data

US 2018/0192762 A1 Jul. 12, 2018

(30) Foreign Application Priority Data

Jul. 8, 2015 (KR) ..... 10-2015-0097258

(51) Int. Cl.
*A45D 40/00* (2006.01)
*B65D 47/00* (2006.01)
*B65D 83/00* (2006.01)
*B05B 11/00* (2006.01)

(52) U.S. Cl.
CPC ..... *A45D 40/0075* (2013.01); *B05B 11/3015* (2013.01); *B05B 11/3056* (2013.01); *B65D 47/00* (2013.01); *B65D 83/0022* (2013.01); *A45D 2200/056* (2013.01); *B05B 11/0038* (2018.08); *B05B 11/00416* (2018.08); *B05B 11/3023* (2013.01)

(58) Field of Classification Search
CPC ..... A45D 40/0075; B65D 83/0022
See application file for complete search history.

(56) References Cited

U.S. PATENT DOCUMENTS

2015/0090739 A1* 4/2015 Jung ..... B05B 11/3025 222/205
2016/0015149 A1* 1/2016 Kim ..... A45D 34/00 222/383.1
2016/0073761 A1* 3/2016 Lee ..... A45D 33/025 132/298

(Continued)

FOREIGN PATENT DOCUMENTS

KR 20-0436889 Y1 10/2007
KR 10-1082427 B1 11/2011
KR 20-0459352 Y1 3/2012

(Continued)

*Primary Examiner* — J C Jacyna
(74) *Attorney, Agent, or Firm* — Novick, Kim & Lee, PLLC; Jae Youn Kim

(57) ABSTRACT

A volume cream vessel is provided, which includes a cream vessel configured to contain a cosmetic content, a rim member mounted on the upper part of the cream vessel, a pumping device seated on the rim member and configured to upwardly pump the cosmetic content inside the cream vessel, a pressing member disposed on an upper part of the pumping device, and a cover member configured to cover an upper part of the pressing member. One edge of the pressing member is coupled to the rim member so as to operate the pumping device by a pressing operation.

5 Claims, 4 Drawing Sheets

(56) References Cited

U.S. PATENT DOCUMENTS

| | | | | |
|---|---|---|---|---|
| 2018/0035785 | A1* | 2/2018 | Lee | A45D 40/00 |
| 2018/0070702 | A1* | 3/2018 | Lee | A45D 40/02 |

FOREIGN PATENT DOCUMENTS

| | | | |
|---|---|---|---|
| KR | 10-1223827 | B1 | 1/2013 |
| KR | 10-1364450 | B1 | 2/2014 |
| KR | 10-2015-0039434 | A | 4/2015 |

* cited by examiner

VOLUME CREAM CONTAINER

TECHNICAL FIELD

The present invention relates to a volume cream vessel and more particularly, to a volume cream vessel in which cream in a cosmetic vessel is upwardly discharged by means of a pressing operation so as to apply a predetermined amount of the discharged cosmetics, and as a result, the cosmetic content is not contaminated and a position of pressing the pressing member and a position of the cream vessel are different from each other to prevent the cream vessel from being contaminated.

BACKGROUND ART

As disclosed in Korean Utility Model Application No. 2006-0029641, generally, women makeup or clean cosmetics applied on the face using various types of cream cosmetics and directly pick and use the content by fingers when the cream cosmetics is used.

As such, when the cream cosmetics is directly picked and used by the fingers, the cream cosmetics can be used more conveniently, while when the finger is not cleaned, a foreign substance on the hand is mixed into the content and the content is deteriorated.

As one method for solving the problem, the cream cosmetics is taken and used by a spatula, and when the cream cosmetics is taken and used by the spatula, the aforementioned problem is solved, but it is inconvenient to separately carry the spatula.

DISCLOSURE

Technical Problem

The present has been made in an effort to provide a volume cream vessel in which cream in a cosmetic vessel is upwardly discharged by means of a pressing operation so as to apply a predetermined amount of the discharged cosmetics, and as a result, the cosmetic content is not contaminated.

Technical Solution

A first embodiment of the present invention provides a volume cream vessel including: a cream vessel 10 which contains a cosmetic content and of which the upper part is opened; a rim member 20 which is inserted into the opening in the upper part of the cream vessel 10; a pumping device 30 which is seated on the rim member 20 and upwardly pumps the cosmetic content inside the cream vessel 10; a pressing member 40 which is provided on the upper part of the pumping device 30, in which one edge 44 of the pressing member 40 is coupled to the rim member 20 so as to operate the pumping device 30 by means of a pressing operation; and a cover member 50 which covers the upper part of the pressing member 40.

The pumping device 30 may include a seating member 31 having a cylindrical projection part 311 which is downwardly projected in a cylindrical shape as a member of which an outer periphery is seated on the rim member 20 and a through hole 312 which is through-formed at an eccentric position of the bottom of the cylindrical projection part 311 to lift the cosmetic content in the cream vessel 10, a cylinder 32 which is vertically inserted to the through hole 312 of the seating member 31, a pump cap 33 on which the upper surface of the cylinder 32 is seated, an operating member set 34 which is installed at the center of the pump cap 33 to upwardly pump the cosmetic content by pressing the pressing member 40, and a cosmetics applying member 35 which is installed at the upper part of the operating member set 34 and protrudes upwardly from one side of the pressing member 40 to apply the cosmetic content which is lifted by the operation of the pump.

The operating member set 34 may include a cylindrical valve 341 which is fitted to the inside to be in close contact with an inner circumferential surface of the cylinder 32, a rod-shaped stem 342 of which an upper end is projected to a central pipe 331 of the pump cap 33 through the upper portion from the lower portion in a central hole 3411 of the cylindrical valve 341 to suck the cosmetic content while moving downward, an operating member 343 which is connected to the upper end of the stem 342 to discharge the cosmetic content sucked in the stem 342 onto the cosmetic applying member 35, a lever 344 of which one side is coupled to an upper side of the seating member 31 through a hinge 3441 and the other side has two blades 3442 to press both side protrusion plates 3431 of the operating member 343, a pair of support arc plates 345 of which an upper end is connected to both side lower ends of the cosmetics applying member 35 and a lower end is inserted to coupling grooves 333 formed on both side supports 332 of the pump cap 33, and a cylindrical spring 346 of which an upper end is supported to a lower surface of the both side protrusion plates 3431 of the operating member 343 and a lower end is support to the inside of the lower end of the side supports 332 of the pump cap 33 to return the operating member 343 when the pressing operation of the pressing member 34 is released.

The stem 342 may be a rod-shaped member of which an upper end has an opening hole 3421 and a lower end has a closed circular plate 3422, in which the upper end is inserted to the lower cylindrical member 3432 of the operating member 343 and a lateral hole 3423 communicating with the opening hole 3421 is formed at an upper portion of the closed circular plate 3422 of the lower end.

The pressing member 40 may have a hole 41 which is projected with the cosmetics applying member 35 and a pressing part 42 pressing the pressing member 40 is concavely formed at one side of the hole 41, and a pressing protrusion 43 is formed at an opposite side of the pressing part 42 so as to be pressed in contact with the lever 34 of the operating member set 34 when pressing the pressing member.

The cylinder 32 may have a cylindrical pipe of which the upper end and the lower end are opened and a check valve 322 is provided at an inner periphery of the lower end.

Advantageous Effects

According to the volume cream vessel of the present invention, since the cream in a cosmetic vessel is upwardly discharged by means of a pressing operation so as to apply a predetermined amount of the discharged cosmetics, the cosmetic content is not contaminated and a position of pressing the pressing member and a position of the cream vessel are different from each other to prevent the cream vessel from being contaminated.

MODES OF THE INVENTION

Hereinafter, a preferable embodiment of the present invention will be described in detail with reference to the accompanying drawings. Moreover, in the following description, a detailed description of related known configurations or functions may be omitted to avoid obscuring the subject matter of the present invention.

[Embodiment]

Figure 1:
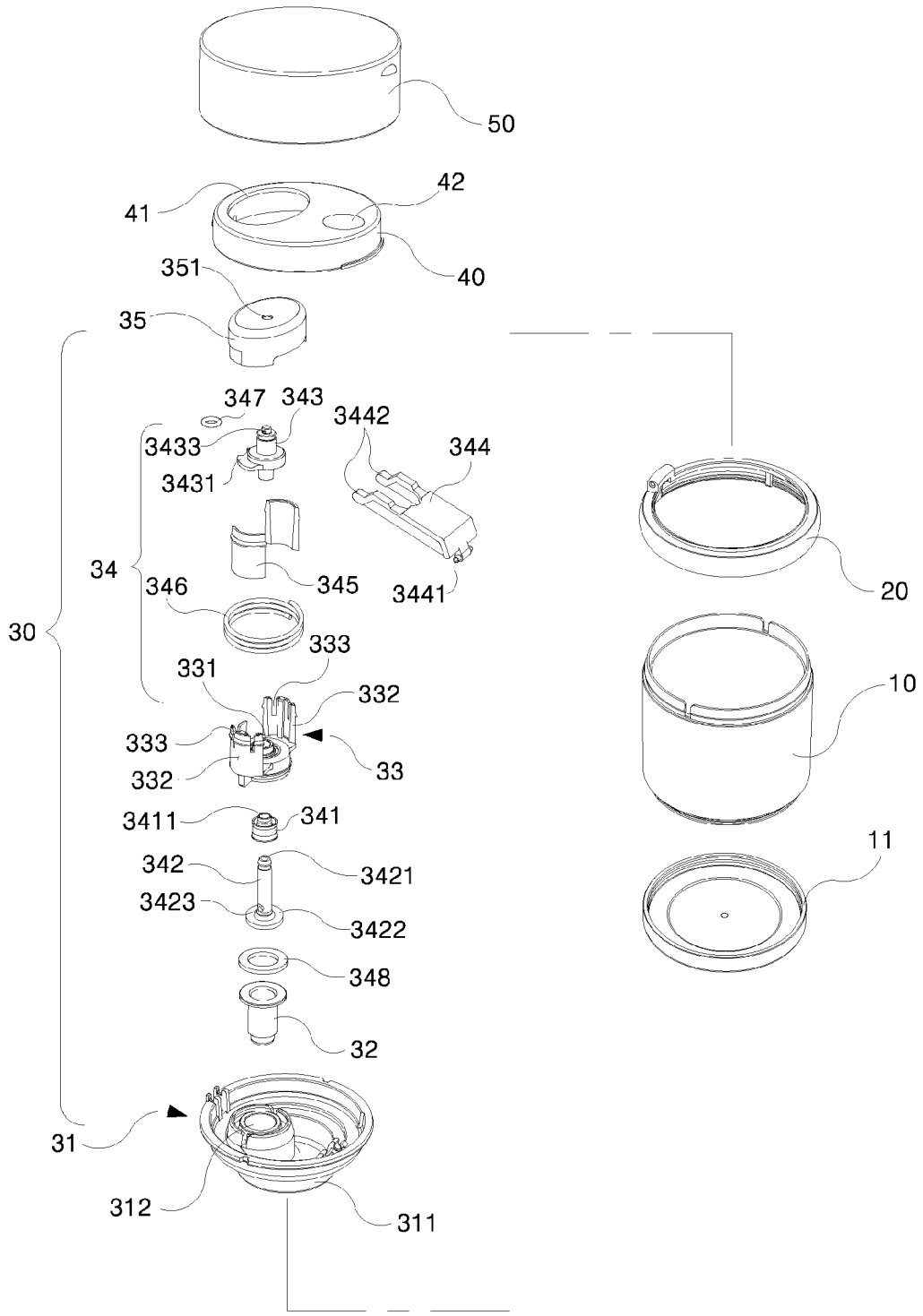
FIG. 1 is an exploded perspective view illustrating a volume cream vessel.
Figure 2:
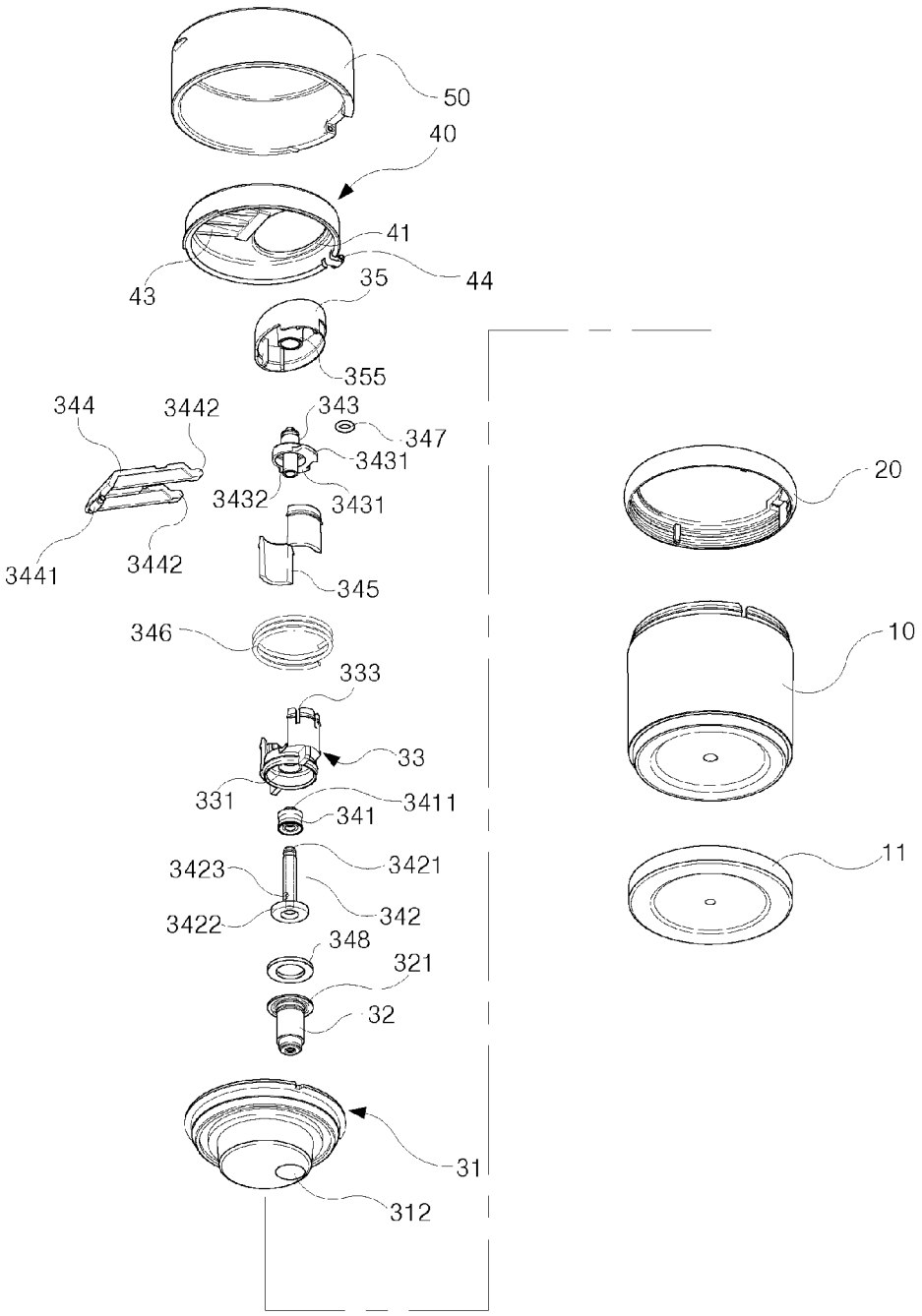
FIG. 2 is an exploded perspective view of the volume cream vessel of the present invention which is viewed from the bottom.
Figure 3:
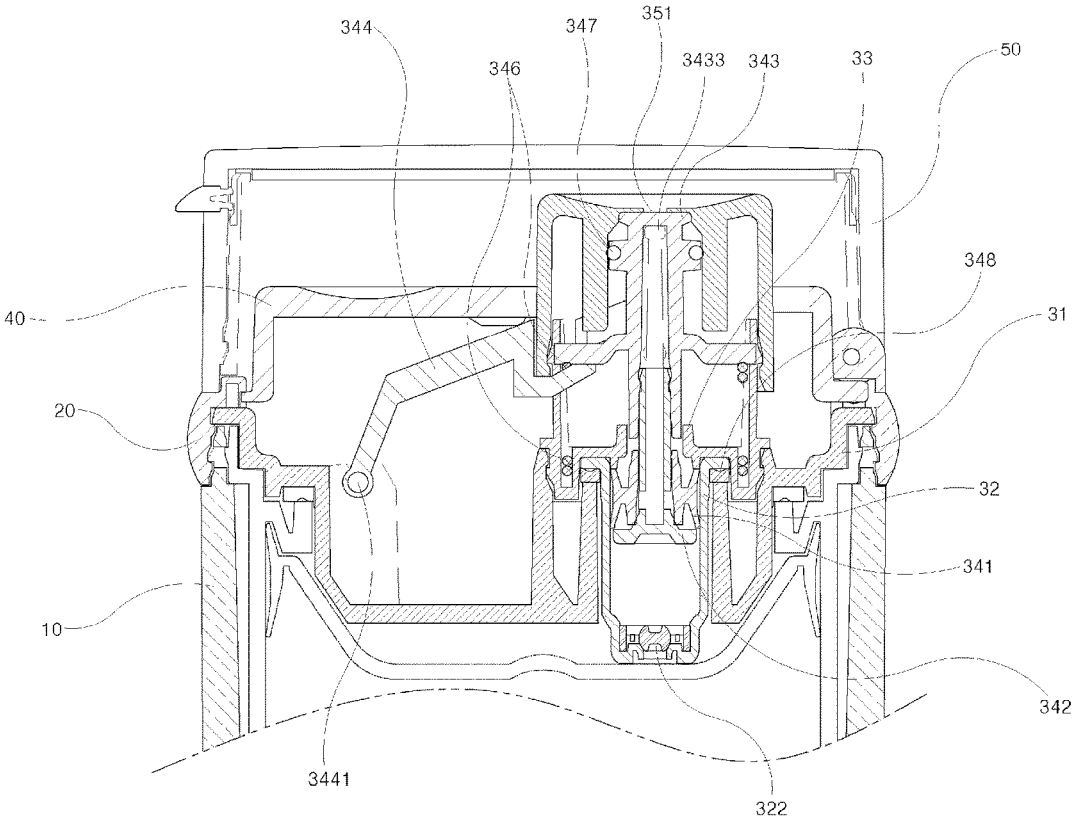
FIG. 3 is a cross-sectional view illustrating the volume cream vessel of the present invention.
Figure 4:
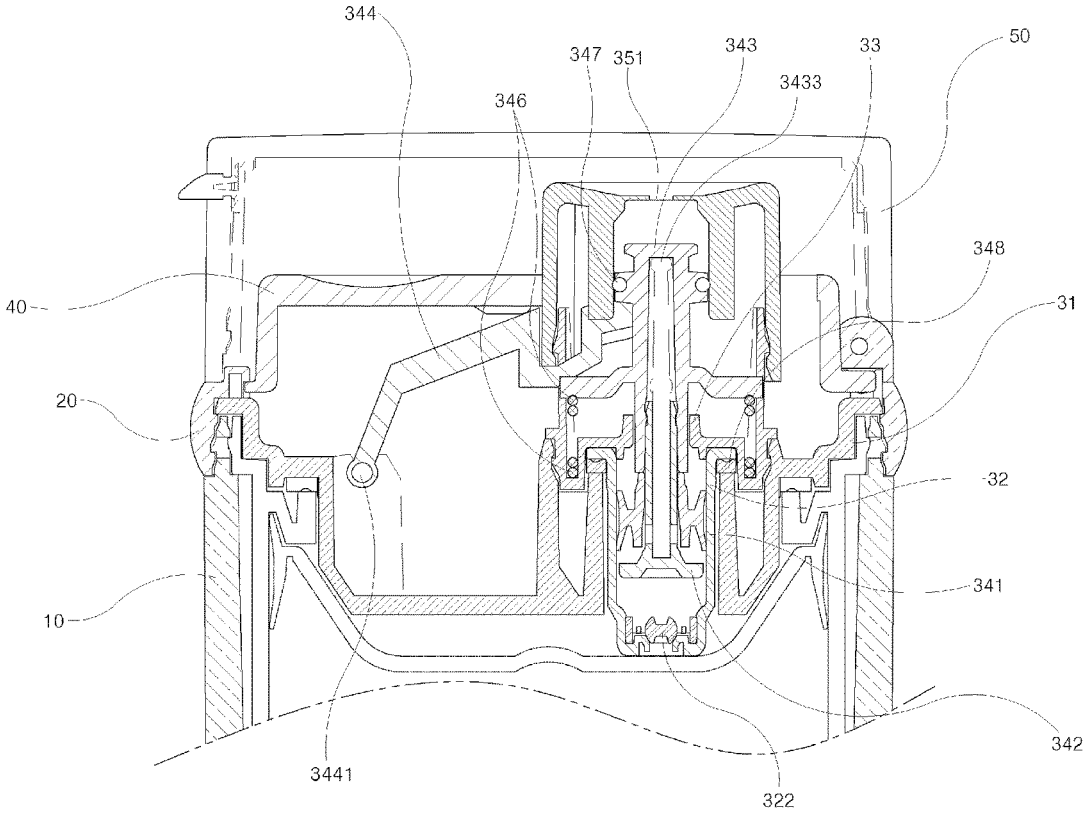
FIG. 4 is a cross-sectional view illustrating a state of pressing a pressing member of the volume cream vessel of the present invention.

FIG. 1 is an exploded perspective view illustrating a volume cream vessel, FIG. 2 is an exploded perspective view of the volume cream vessel of the present invention which is viewed from the bottom, FIG. 3 is a cross-sectional view illustrating the volume cream vessel of the present invention, and FIG. 4 is a cross-sectional view illustrating a state of pressing a pressing member of the volume cream vessel of the present invention.

As illustrated in FIGS. 1 to 4, a volume cream vessel of the present invention includes a cream vessel 10 which contains a cosmetic content and of which the upper part is opened, a rim member 20 which is inserted into the opening in the upper part of the cream vessel 10, a pumping device 30 which is seated on the rim member 20 and upwardly pumps the cosmetic content inside the cream vessel 10, a pressing member 40 which is provided on the upper part of the pumping device 30, in which one edge 44 of the pressing member 40 is coupled to the rim member 20 so as to operate the pumping device 30 by means of a pressing operation, and a cover member 50 which covers the upper part of the pressing member 40.

The pumping device 30 includes a seating member 31 having a cylindrical projection part 311 which is downwardly projected in a cylindrical shape as a member of which an outer periphery is seated on the rim member 20 and a through hole 312 which is through-formed at an eccentric position of the bottom of the cylindrical projection part 311 to lift the cosmetic content in the cream vessel 10, a cylinder 32 which is vertically inserted to the through hole 312 of the seating member 31, a pump cap 33 on which the upper surface of the cylinder 32 is seated, an operating member set 34 which is installed at the center of the pump cap 33 to upwardly pump the cosmetic content by pressing the pressing member 40, and a cosmetics applying member 35 which is installed at the upper part of the operating member set 34 and protrudes upwardly from one side of the pressing member 40 to apply the cosmetic content which is lifted by the operation of the pump.

The operating member set 34 includes a cylindrical valve 341 which is fitted to the inside to be in close contact with an inner circumferential surface of the cylinder 32, a rod-shaped stem 342 of which an upper end is projected to a central pipe 331 of the pump cap 33 through the upper portion from the lower portion in a central hole 3411 of the cylindrical valve 341 to suck the cosmetic content while moving downward, an operating member 343 which is connected to the upper end of the stem 342 to discharge the cosmetic content sucked in the stem 342 onto the cosmetic applying member 35, a lever 344 of which one side is coupled to an upper side of the seating member 31 through a hinge 3441 and the other side has two blades 3442 to press both side protrusion plates 3431 of the operating member 343, a pair of support arc plates 345 of which an upper end is connected to both side lower ends of the cosmetics applying member 35 and a lower end is inserted to coupling grooves 333 formed on both side supports 332 of the pump cap 33, and a cylindrical spring 346 of which an upper end is supported to a lower surface of the both side protrusion plates 3431 of the operating member 343 and a lower end is support to the inside of the lower end of the side supports 332 of the pump cap 33 to return the operating member 343 when the pressing operation of the pressing member 34 is released.

The support arc plate 345 is a member supporting the cosmetics applying member 35 so as not to descend even though the operating member 343 descends by means of the pressing operation of the lever 344 at the lower end of the cosmetics applying member 35.

The stem 342 is a rod-shaped member of which an upper end has an opening hole 3421 and a lower end has a closed circular plate 3422, in which the upper end is inserted to the lower cylindrical member 3432 of the operating member 343 and a lateral hole 3423 communicating with the opening hole 3421 is formed at an upper portion of the closed circular plate 3422 of the lower end.

The operating member 343 has a discharge hole 3433 through which the cosmetics introduced through the lower cylindrical member 3432 is discharged to the upper side surface thereof. The pressing member 40 has a hole 41 which is projected with the cosmetics applying member 35 and a pressing part 42 pressing the pressing member 40 is concavely formed at one side of the hole 41, and a pressing protrusion 43 is formed at an opposite side of the pressing part 42 so as to be pressed in contact with the lever 34 of the operating member set 34 when pressing the pressing member.

The cylinder 32 has a cylindrical pipe of which the upper end and the lower end are opened and a check valve 322 is provided at an inner periphery of the lower end. The check valve 322 is a member which is opened when a volume of the cylinder 32 is decreased by pressing the pressing member 40 while the stem 342 descends to suck the cosmetic content in the cream vessel 10 into the cylinder 32 and closes a lower hole of the cylinder 32 when the pressing operation of the pressing member 40 is released.

Reference numeral 347 (not illustrated) is an O ring which is inserted to the outer circumferential surface of an upper discharge port of the operating member 343 and seated on the inner periphery of the discharge hole 351 of the cosmetics pressing member 35, reference numeral 348 is a planar ring which is inserted to a lower outer periphery of the central pipe 331 of the pump cap 33 and in contact with an upper flange 321 of the cylinder 32 to maintain airtightness, and reference numeral 11 is an external plate which is screw-coupled to the lower surface of the cream vessel 20 to make an appearance good.

Next, the operations and effects of the volume cream vessel of the present invention configured as described above will be described.

First, in order to use the cosmetic content, that is, the cream, when the cover member 50 is opened and the pressing part 42 having the circular grooves formed on the upper surface of the pressing member 40 is pressed downward, the pressing protrusion 43 projected downwardly on the lower surface of the pressing part 42 presses the lever 344 of the lower portion thereof while the pressing member 40 descends to press the both side protrusion plates 3431 of the operating member 343 which is disposed through the both blades 3442 of the lever 344 thereof.

The operating member 343 descends and the stem 342 connected to the lower end of the operating member 343 descends in the cylinder 32, and then the volume of the cylinder 32 is reduced to suck the cosmetic content in the cream vessel 10 through the check valve 322.

As such, the sucked cosmetics is introduced into the stem 342 through the lateral hole 3423 of the stem 342 to be lifted to the opening hole 3421 and discharged to the upper discharge hole 3433 through the lower cylindrical member 3432 of the operating member 343 and then discharged onto the cosmetics applying member 35.

The cosmetics, that is, the cream discharged above is applied on the face.

When the pressing of the pressing member 40 is released, the operating member 343 ascends while the compressed cylindrical spring 346 is expanded and simultaneously, the stem 342 in the cylinder 32 ascends, and the lateral hole 3423 of the stem 342 is positioned in the inner periphery of the central hole 3411 of the cylindrical valve 341 so that the introduction of the cosmetic is blocked.

According to the volume cream vessel of the present invention, since the cream in a cosmetic vessel is upwardly discharged by means of a pressing operation so as to apply a predetermined amount of the discharged cosmetics, the cosmetic content is not contaminated and a position of pressing the pressing member and a position of the cream vessel are different from each other to prevent the cream vessel from being contaminated.

As described above, detailed embodiments have been described in the detailed description of the present invention, but a possibility that the technology of the present invention will be easily modified and executed by those skilled in the art is apparent and the modified embodiments will be included in the technical spirit disclosed in the appended claims of the present invention.

[Explanation of Reference Numerals and symbols]

| | |
|---|---|
| 10: Cream vessel | 11: External plate |
| 20: Rim member | 30: Pumping device |
| 31: Seating member | 311: Cylindrical projection part |
| 312: Through hole | 32: Cylinder |
| 321: Upper flange | 322: Check valve |
| 33: Pump cap | 331: Central pipe |
| 332: Both side supports | 333: Coupling groove |
| 34: Operating member set | 341: Cylindrical valve |
| 3411: Central hole | 342: Stem |
| 3421: Opening hole | 3422: Closed circular plate |
| 3423: Lateral hole | 343: Operating member |
| 3431: Both side protrusion plates | 3432: Lower cylindrical member |
| 3433: Upper discharge hole | 344: Lever |
| 3441: Hinge | 3442: Both blades |
| 345: Support arc plate | 346: Cylindrical spring |
| 347: O ring | 348: Planar ring |
| 35: Cosmetics applying member | 351: Discharge hole |
| 40: Pressing member | 41: Hole |
| 42: Pressing part | 50: Cover member |

The invention claimed is:

1. A volume cream vessel, comprising:

a cream vessel configured to contain a cosmetic content, the cream vessel having an open upper part;

a rim member mounted on the upper part of the cream vessel;

a pumping device seated on the rim member and configured to upwardly pump the cosmetic content inside the cream vessel;

a pressing member disposed on an upper part of the pumping device, wherein one edge of the pressing member is coupled to the rim member so as to operate the pumping device by a pressing operation; and a cover member configured to cover an upper part of the pressing member, wherein the pumping device includes:

a seating member having a cylindrical projection part which is downwardly projected in a cylindrical shape and a through hole which is formed through an eccentric position of a bottom of the cylindrical projection part to lift the cosmetic content in the cream vessel, wherein an outer periphery of the cylindrical projection part is seated on the rim member;

a cylinder which is vertically disposed in the through hole of the seating member;

a pump cap on which an upper surface of the cylinder is seated;

an operating member set which is disposed at a center of the pump cap to upwardly pump the cosmetic content by pressing the pressing member; and a cosmetics applying member which is disposed at an upper part of the operating member set and protrudes upwardly from one side of the pressing member to apply the cosmetic content which is lifted by a pumping operation of the operating member set.

2. The volume cream vessel of claim 1, wherein the operating member set includes a cylindrical valve which is fitted to an inside to be in close contact with an inner circumferential surface of the cylinder;

a rod-shaped stem having an upper end which is projected to a central pipe of the pump cap through a central hole of the cylindrical valve to suck the cosmetic content while moving downward;

an operating member which is connected to the upper end of the stem to discharge the cosmetic content sucked in the stem onto the cosmetic applying member;

a lever having one side which is coupled to an upper side of the seating member through a hinge and another side which has two blades to press both side protrusion plates of the operating member;

a pair of support arc plates each having an upper end which is connected to each of both side lower ends of the cosmetics applying member and a lower end which is coupled to each of coupling grooves formed on both side supports of the pump cap; and a cylindrical spring having an upper end which supports a lower surface of the both side protrusion plates of the operating member and a lower end which supports an inside of the lower end of the side supports of the pump cap to return the operating member when the pressing operation of the pressing member is released.

3. The volume cream vessel of claim 1, wherein the stem is a rod-shaped member having an upper end having an opening hole, wherein a lower end of the stem has a closed circular plate, and the upper end of the stem is coupled to a lower cylindrical member of the operating member, and wherein a lateral hole communicating with the opening hole is formed at an upper portion of the closed circular plate of the lower end of the stem.

4. The volume cream vessel of claim 1, wherein the pressing member has a hole through which the cosmetics applying member is projected and a pressing part for pressing the pressing member is concavely formed at one side of the hole, and wherein a pressing protrusion is formed at an opposite side of the pressing part so as to be pressed in contact with the lever of the operating member set when pressing the pressing member.

5. The volume cream vessel of claim 1, wherein the cylinder has a cylindrical pipe having an upper end and a lower end opened, and wherein a check valve is disposed at an inner periphery of the lower end of the cylindrical pipe.

* * * * *